US005754985A

United States Patent [19]

Dias

[11] Patent Number: 5,754,985

[45] Date of Patent: May 26, 1998

[54] TOILET SEAT APPARATUS

[76] Inventor: Arnaldo Das Neves Dias, 250 Hallam Street, Toronto, Ontario, Canada, M6H 1Y1

[21] Appl. No.: 729,739

[22] Filed: Oct. 7, 1996

[51] Int. Cl.[6] ..... A47K 13/04

[52] U.S. Cl. ..... 4/246.1; 4/241

[58] Field of Search ..... 4/246.1, 246.2, 4/246.3, 246.4, 246.5, 248, 253, 241

[56] References Cited

U.S. PATENT DOCUMENTS

| | | | |
|---|---|---|---|
| 651,049 | 6/1900 | Lewis . | |
| 2,200,687 | 5/1940 | Bercot . | |
| 2,632,896 | 3/1953 | Morikawa . | |
| 5,056,165 | 10/1991 | Wescott, Sr. . | |
| 5,177,818 | 1/1993 | Tsai . | |
| 5,280,653 | 1/1994 | Tsai . | |
| 5,319,810 | 6/1994 | Metzger . | |
| 5,323,496 | 6/1994 | Blair . | |
| 5,394,570 | 3/1995 | Tzang | 4/246.1 |
| 5,437,063 | 8/1995 | Cotham | 4/246.1 |

*Primary Examiner*—David J. Walczak
*Attorney, Agent, or Firm*—Barrigar & Moss

[57] ABSTRACT

Apparatus for raising and lowering a pivoting toilet member mounted on top of a toilet bowl that is part of a flushing toilet equipped with a water tank. Apparatus includes first and second weights, the first weight being connectible to the toilet member and provided to raise the toilet member, the second weight being adapted for mounting in the water tank and provided to lower the toilet member. The second weight is connected to the toilet member by a connecting mechanism which includes an elongate, flexible member capable of extending from the second weight inside the water tank to a connecting point outside the water tank. A holding mechanism releasably holds the connecting mechanism, which prevents the toilet member from pivoting from a lowered position to a raised position until the holding mechanism is disengaged. If the toilet member is in a raised position when the toilet is flushed, the toilet member will move to its lowered position due to downward movement of said second weight.

21 Claims, 6 Drawing Sheets

TOILET SEAT APPARATUS

BACKGROUND OF THE INVENTION

The present invention relates to a device for raising and lowering a toilet seat.

Typically, when a user desires to place the seat of a toilet in the raised position, the user must stoop his body and grasp the seat by hand to rotate it to the raised position. Conversely, if the seat is in a raised position and a user desires to place the seat in a lowered position, the user must grasp the seat and support it with his or her hand as they lower it all the way down to its lowered position. This task of raising and lowering the toilet seat may be painful for users with lower back problems. Additionally, a frequent problem with conventional toilet seats is that a user who has placed the seat in a raised position will frequently forget to lower the seat after flushing the toilet, thereby inconveniencing a subsequent user who desires to have the seat in a lowered position. Raising and lowering a toilet seat by hand is also unappealing for hygienic reasons.

Various prior art devices have been conceived to assist in the operation of a toilet seat.

U.S. Pat. No. 5,177,818 to Tsai, issued Jan. 12, 1993, discloses a toilet seat lifting device in which a toilet seat is held in a typically open position by the weight of a piston contained in a hydraulic cylinder unit. A user who desires to lower the seat can do so by actuating a control valve which admits fluid into the base of the hydraulic cylinder unit, thereby pushing up the piston and causing the toilet seat to lower. In order to maintain the seat in a lowered position, weight must be applied to the seat. Such an apparatus can be inconvenient as it maintains the toilet seat in a generally raised position. Additionally, installation of the device requires additional plumbing. U.S. Pat. No. 5,280,653 to Tsai discloses a similar device.

U.S. Pat. No. 5,056,165 issued Oct. 15, 1991 to R. E. Wescott, Sr. and U.S. Pat. No. 5,323,496 issued Jun. 28, 1994 to S. F. Blair each disclose mechanical foot lever apparatus to assist in the raising and lowering of a toilet seat. The disclosed apparatus each employ pedal mechanisms which rest on the floor area near the toilet, which can be inconvenient as such area is frequently in need of cleaning.

It is thus desirable to provide a toilet seat raising and lowering apparatus which is easy to install and use with a conventional toilet, reduces back strain on a user, ensures that the toilet seat is always in a lowered position after flushing, and is hygienic.

SUMMARY OF THE INVENTION

In accordance with one aspect of the invention, there is provided an apparatus for raising and lowering a pivoting toilet member mounted on top of a toilet bowl, the bowl being part of a flushing toilet equipped with a water tank. The apparatus includes first and second weights, the first weight being connectible to the toilet member and provided to raise the toilet member, the second weight being adapted for mounting in the water tank and provided to lower the toilet member. A connecting mechanism is included for connecting the second weight to the toilet member and the connecting mechanism includes an elongate, flexible member capable of extending from the second weight inside the water tank to a connecting point outside the water tank. The apparatus also includes a holding mechanism for releasably holding the connecting mechanism in a holding position where the connecting mechanism prevents the toilet member from pivoting from a lowered position to a raised position. During use of the apparatus, if the toilet member is in the lowered position, disengagement of the holding mechanism from said connecting mechanism causes the toilet member to be pivoted to its raised position due to downward movement of the first weight and, if said toilet member is in the raised position and the toilet is flushed, the toilet member moves to its lowered position due to downward movement of said second weight in said water tank.

Preferably, the holding mechanism includes a catch, a support device for pivotably mounting said catch on said water tank, and a stopper fixedly connected to the flexible member at a predetermined position. The apparatus may include a pivotable shaft for connecting the toilet member to the top of the toilet bowl and a first lever member rigidly connected to the shaft and extending radially outwardly therefrom. Preferably, the first weight is connected to an outer end of the first lever member, and the connecting mechanism includes a further lever member rigidly connected to the shaft and extending radially outwardly therefrom, the flexible member being connected to an outer end of the further lever member.

In accordance with a further aspect of the invention, there is provided an apparatus for a toilet having a toilet bowl, a tank, and a toilet member pivotally mounted on said toilet bowl for pivotal movement about a horizontal axis between a lowered position and a raised position, where the toilet has a normal state during which the tank is substantially full of water and a flushing state during which the water is drained from the tank. The apparatus includes a first weight movable between a raised position and a lowered position and a second weight locatable in the tank such that during use of the apparatus when the toilet is in its normal state, the second weight is acted upon by the buoyant forces of the water in the tank. The apparatus also includes means for connecting the first weight and the second weight to the toilet member such that downward movement of the first weight causes the toilet member to rise and downward movement of the second weight when the first weight is not in its raised position causes the toilet member to lower, a catch connectible to the toilet and having at least a first position and a second position, and a stopper for releasably connecting said catch to the connecting means such that when the catch is in its first position and the toilet member is in its lowered position, the first weight is prevented from moving downwards. When the toilet member is in its lowered position and the toilet is in its normal state and the catch is moved from its first position to its second position, the first weight moves downwards thereby causing the toilet member to move to its raised position, and when the toilet member is in its raised position and the toilet is in its flushing state, the toilet member moves to said lowered position under the force of the second weight.

In accordance with still a further aspect of the invention, there is provided an apparatus for a toilet having a toilet bowl, a tank, and a seat pivotally mounted on said toilet bowl for pivotal movement about a horizontal axis between a lowered position and a raised position, the toilet having a normal state during which the tank is substantially full of water and a flushing state during which the water is drained from the tank. The apparatus comprises an elongate shaft adapted to be rotatably mounted on the toilet along said horizontal axis, a first weight movable between a raised position and a lowered position, and means connecting the first weight to the shaft such that downward movement of the first weight causes the shaft to rotate in a first direction. Also included is a second weight locatable in the tank such that the second weight is subject to the buoyant forces of the water in the tank when the toilet is in its normal state, means connecting the second weight to the shaft such that downward movement of the second weight when the first weight is not in its raised position causes the shaft to rotate in a direction opposite said first direction, and means for connecting the shaft to the seat such that rotation of the shaft in the first direction when the seat is in its lowered position will cause the seat to be raised, and rotation of the shaft in the opposite direction when the seat is in its raised position will cause the seat to be lowered. The apparatus also has a means for releasably preventing rotation of the shaft in the first direction when the first weight is in its raised position, the releasability of the rotation preventing means being controlled by a user of the toilet, wherein during use of the apparatus when the seat is in its lowered position, the toilet is in its normal state, and the rotation preventing means is moved to a release position by a user, the shaft is caused by the first weight to rotate in the first direction until the seat is in its raised position, and when the seat is in its raised position and the toilet is in its flushing state, said shaft is caused by the second weight to rotate in its opposite direction until the seat is in its lowered position.

DETAILED DESCRIPTION OF THE PREFERRED EMBODIMENTS

Figure 1:
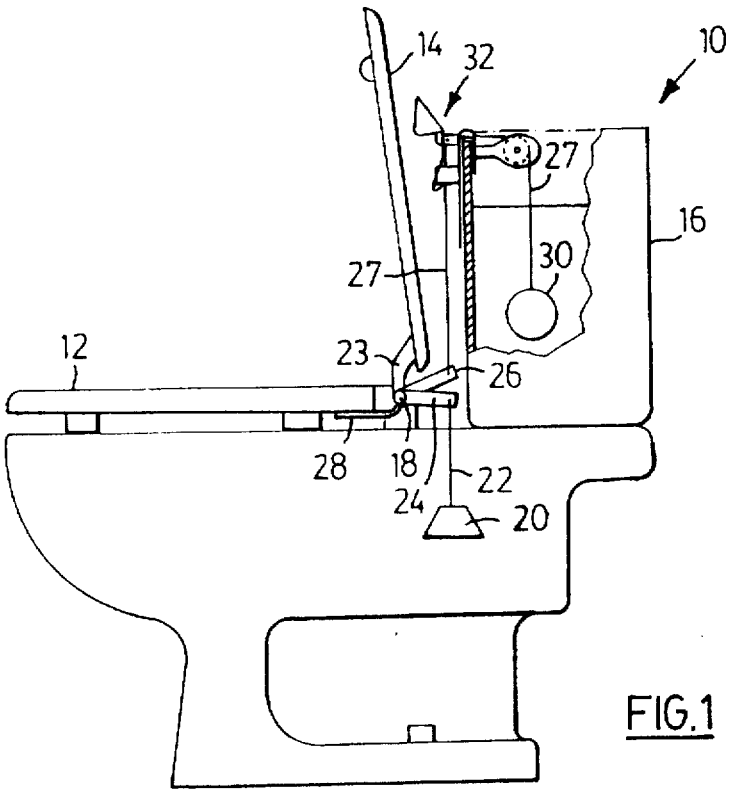
FIG. 1 is a side view of a first embodiment of the invention applied to a toilet with the seat in a lowered position.
Figure 2:
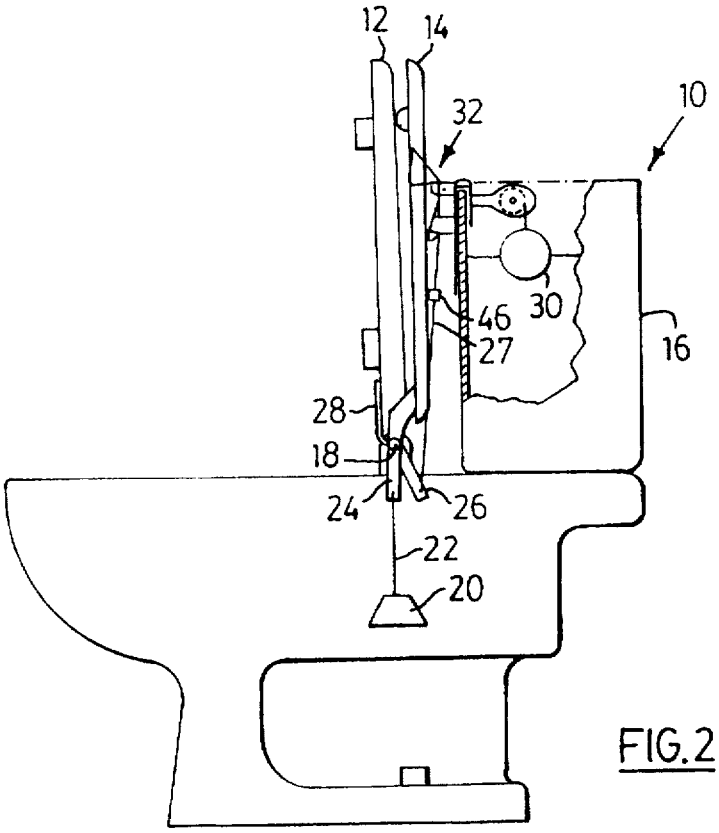
FIG. 2 is a side view of the first embodiment of the invention applied to a toilet with the seat in a raised position.
Figure 3:
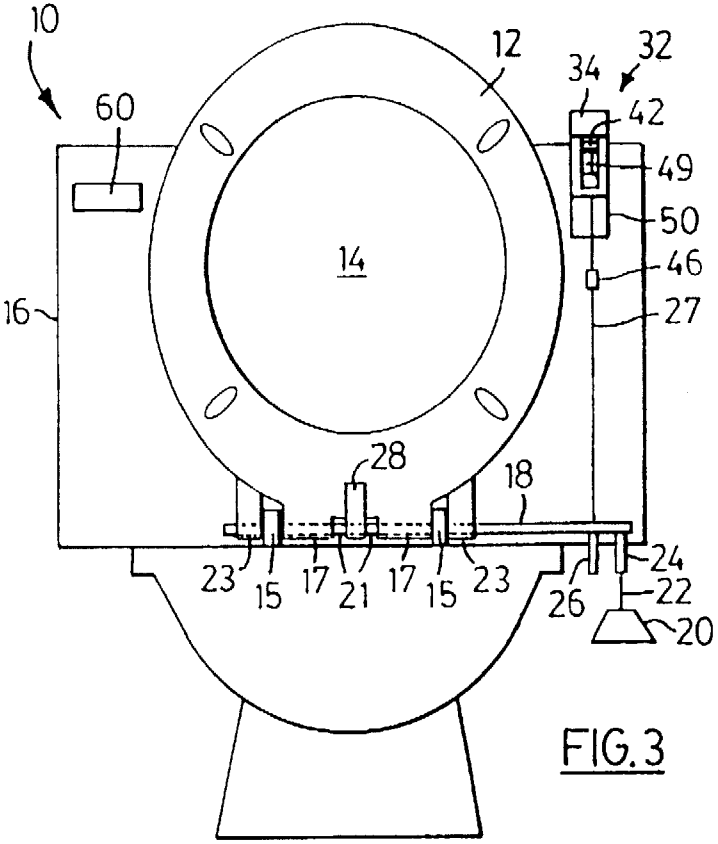
FIG. 3 is a front view of the first embodiment with the seat in a raised position.

Referring to FIGS. 1 to 3, one preferred embodiment of the toilet seat apparatus of the invention is shown mounted on a conventional toilet. Two pivoting toilet members comprising a toilet seat 12 and lid 14 are pivotally mounted by their respective mounting lugs 17 and 23 to the conventional mounting lugs 15 of a toilet 10 by an elongate pivot shaft 18. The toilet member or seat 12 is movable between a lowered position, as shown in FIG. 1, and a raised position, as shown in FIG. 2. The shaft 18 is preferably made of stainless steel, although it could be made of plastic or some other material of appropriate strength, and it may be hollow or solid.

Three lever arms or lever members 24, 26 and 28 extend radially outward from the longitudinal axis of the shaft 18. The lever arm 28 extends from the shaft 18 such that it can engage the underside of the seat 12. In the embodiment of the invention illustrated, the lever arm 28 extends from the shaft 18 through a gap 21 between the mounting lugs 17 of the toilet seat 12.

The lever arms or lever members 24 and 26 are attached to a portion of the shaft 18 that extends beyond the mounting lugs 23 of the lid 14. The lever arms 24, 26 and 28 are preferably made of stainless steel or plastic, and can be connected to the shaft 18 in any one of a variety of ways well known in the art as long as the lever arms are rigidly connected to the shaft 18 such that when the shaft 18 rotates each of the lever arms also rotates and vice versa.

Preferably, the lever arm 28 and the lever arm 24 extend from the shaft 18 in substantially opposite directions and, when the seat 12 is in its lowered position, the lever arms 24 and 28 extend in a generally horizontal plane.

A first weight 20 is attached to the extending end of the lever arm 24 preferably by a cord 22 or similar elongate, flexible member. Referring to FIGS. 1 and 2, the downward force applied by the weight 20 is translated through the lever arm 24 into a clockwise rotational force on the shaft 18. If sufficient counter-rotational (ie. counter clockwise) force is not also applied to the shaft 18, then the force applied by the first weight 20 will be redirected through the lever arm 28 into an upwards rotational force on the toilet seat 12.

The further lever member 26 is provided so that a rotational force can be applied to the shaft 18 to counterbalance, and in some circumstances exceed, the rotational force applied to the shaft 18 by the first weight 20. When the toilet seat 12 is in a lowered position, the lever arm or member 26 extends radially away from the shaft 18 in a direction that is generally away from the seat 12 and divergent from the lever arm 24 in an upwards direction. Although the lever arms 24 and 26 are shown as two separate elongate members, it is possible that the lever arms 24 and 26 could both extend in the same plane and be formed from the same metal or plastic plate.

An elongate, flexible member 27, which may be a cord or a similar connector which is flexible for at least a portion of its length, extends upwards from the further lever arm 26 to a unit 32. The cord 27 is redirected substantially 180 degrees by the unit 32 into the tank 16 of the toilet 10, where it is connected to a second weight 30.

Figure 4:
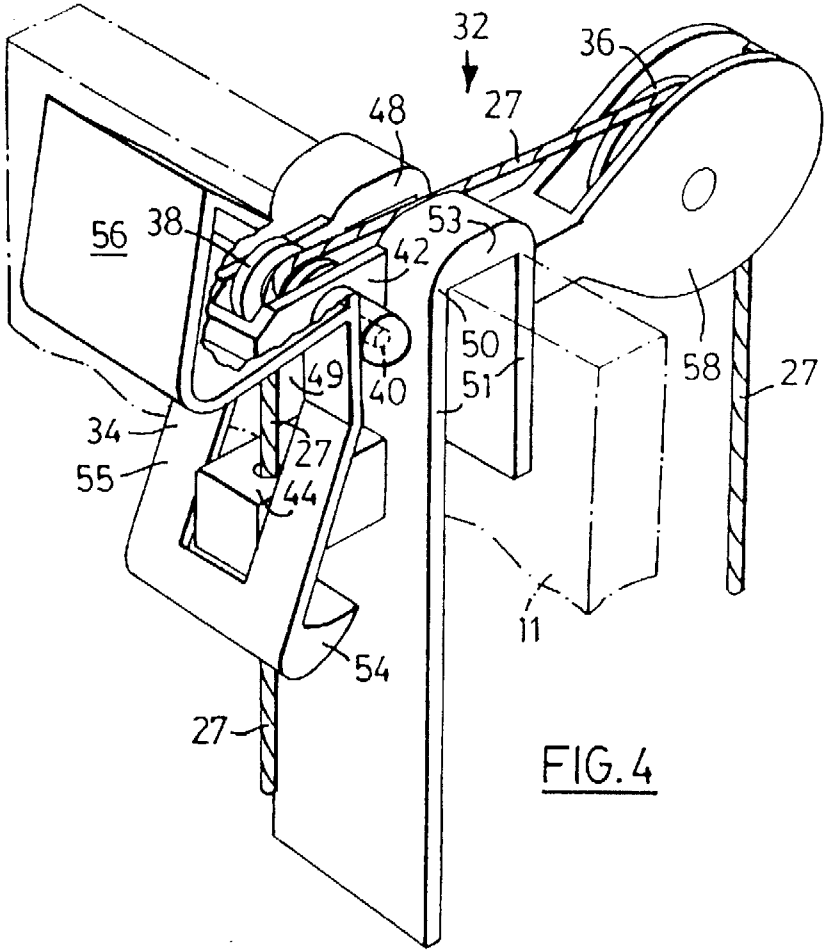
FIG. 4 is a perspective view of the catch unit of the first embodiment.
Figure 5A:
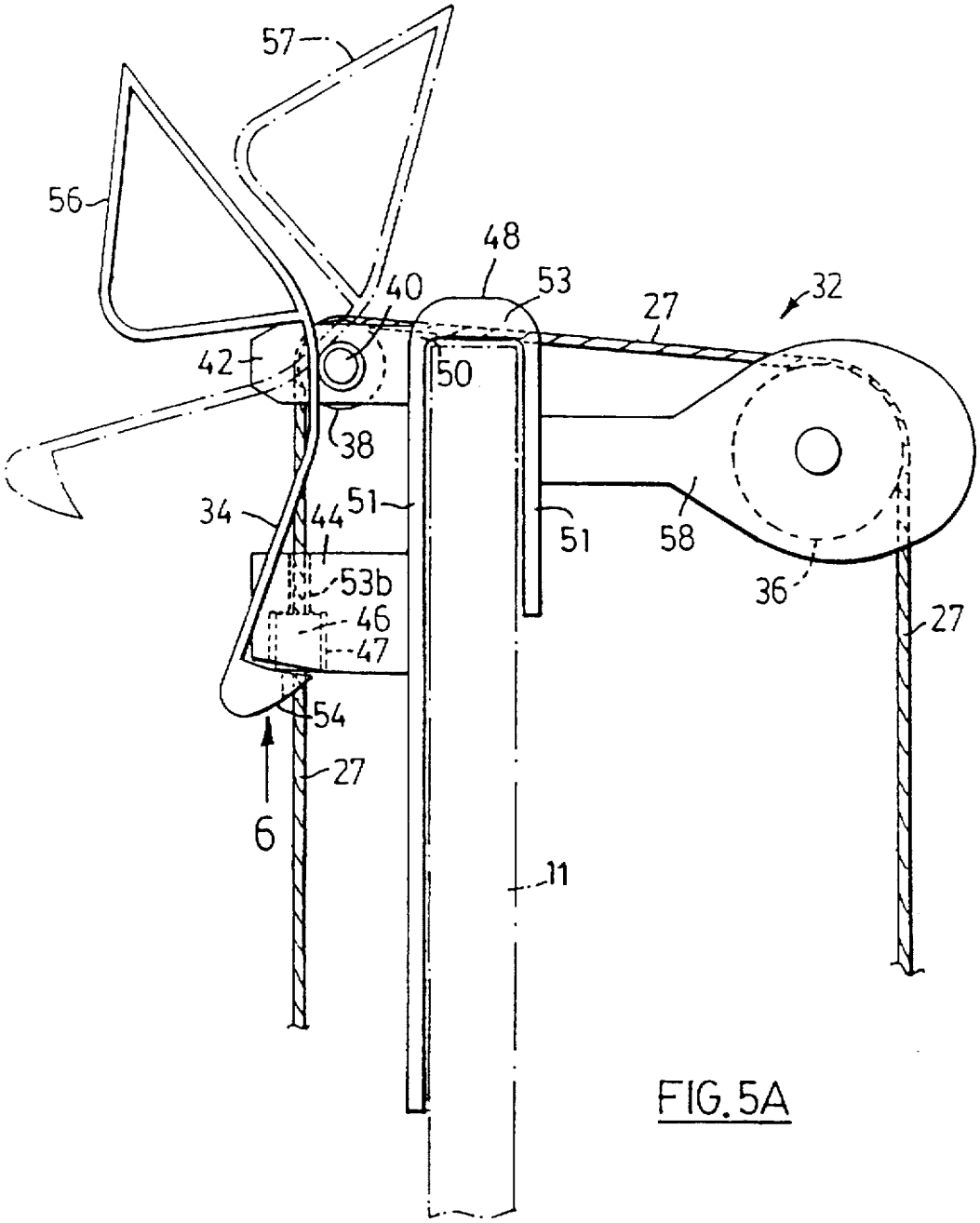
FIG. 5A is a side view of the catch unit of the first embodiment.
Figure 5B:
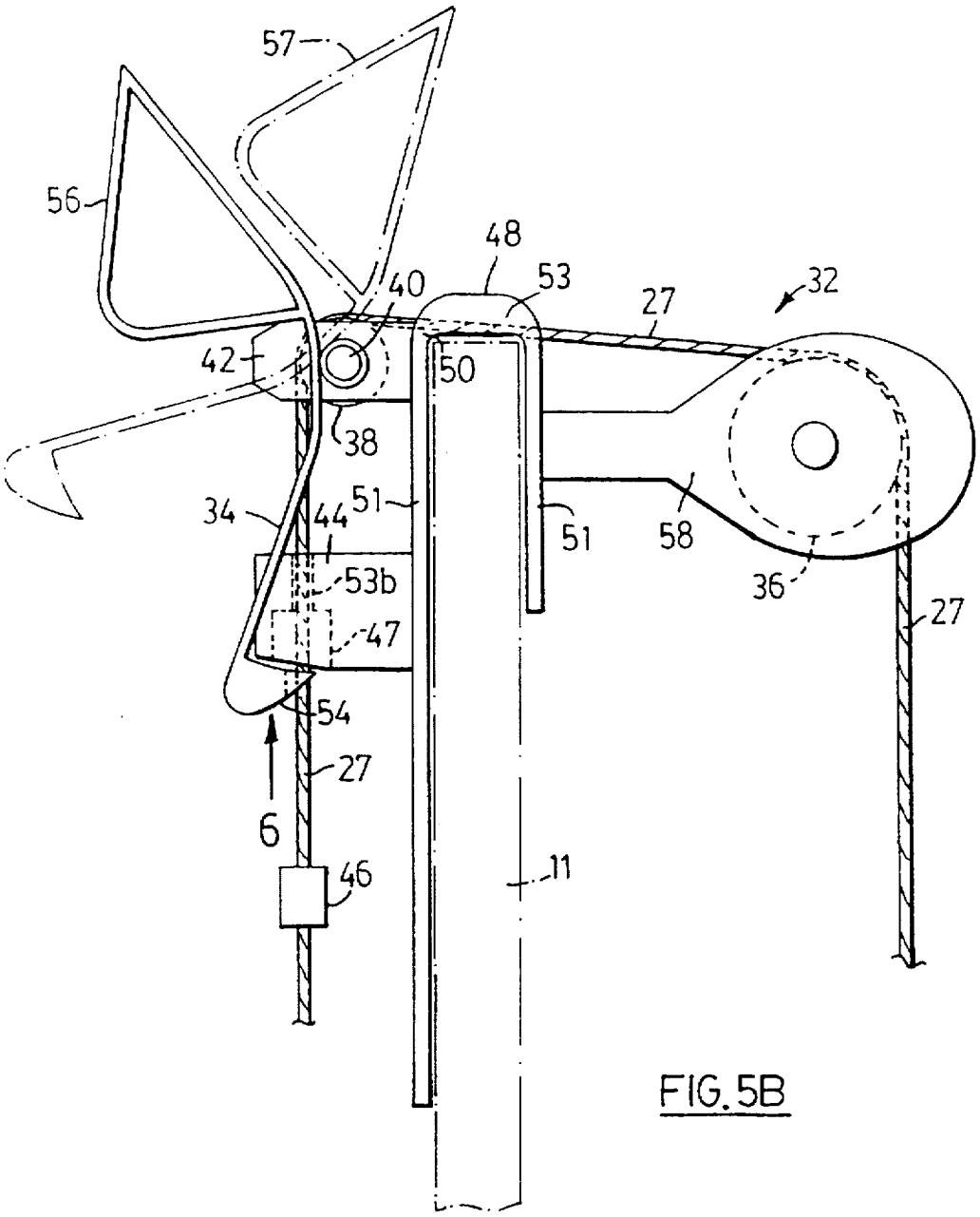
FIG. 5B is a further side view of the catch unit of the first embodiment.
Figure 6:
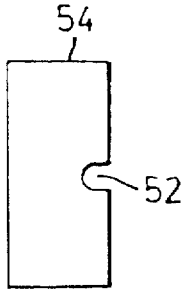
FIG. 6 is a partial bottom view of the catch of the catch unit of FIGS. 4 and 5.

Referring to FIGS. 4 through 6, the unit 32 includes a support device 50 which is preferably comprised of two vertically extending, opposing members 51 that are joined together by an upper connecting section 53 to form a generally inverted J shape. The connecting section 53 and the two opposing members 51 are dimensioned so that the unit 32 can be attached to the front wall 11 of the toilet tank 16, which is a conventional toilet tank. When the support device 50 is mounted on the toilet tank 16, a portion of the front wall 11 of the tank extends between the opposing members 51 and the underside of the upper connecting section 53 rests on the upper edge of the front wall 11 of the tank 16. The support device 50 is preferably made out of stainless steel but any material of sufficient resilience and strength may be used, including some plastics.

The unit 32 is preferably attached to the front wall 11 of the tank 16 so that it generally lines up vertically with the lever arm 26 when the toilet seat 12 is in a lowered position. Preferably, the unit 32 is located on a portion of the front of the tank 16 that is remote from the flush handle 60 so that the operation of the apparatus of the invention does not interfere with the standard flush mechanism of the toilet 10. In the illustrated embodiment, the flush handle 60 is on the left portion of the front wall of the toilet 10, which is where the flush handle is normally located on conventional toilets, and the unit 32 is located on the right portion.

The unit 32 includes a cord guide 44 which extends from the support device 50 in a forwards direction. A through hole **53*b*, which is indicated by dashed lines in FIG. 5, extends through the cord guide 44 in a vertical direction. The lower portion 47 of the through hole 53*b* is enlarged so that it can provide a receptacle for a stopper 46 which is attached to the cord 27 in a fixed location. The stopper 46 may be a metal or a plastic sleeve which is crimped or otherwise fastened to the cord 27, or it may even be a simple knot in the cord 27**.

The unit 32 includes a catch 34 which is pivotally mounted to a support member or bracket 42 which extends from the support device 50. The catch 34 is pivotably mounted to the bracket 42 by a pin 40 which extends along a horizontal axis through the catch 34 and the bracket 42. A first pulley wheel 38 is pivotably mounted to the bracket 42 by the pin 40. The catch 34 preferably has an elongate vertical slot 49 through which a forward portion of each of the bracket 42 and the cord guide 44 can protrude.

The cord 27 extends upwards from the further lever arm 26 through the hole **53*b* in the cord guide 44 and through the slot 49 in the catch 34 where it is then redirected by the first pulley wheel 38 to the connecting section 53 of the support device 50. The connecting section 53 preferably includes a passage such as a cord guide groove 48 in its upper surface through which the cord 27 passes and is free to move. The guide groove 48 guides the cord 27 over the top edge of the front wall 11 of the tank 16. A support member, such as a pulley unit 58 which includes a second pulley wheel 36, extends into the tank from the support frame device 50. The cord 27 passes over the second pulley wheel 36 and extends downwards into the tank 16 where the end of the cord 27 is attached to the second weight 30. Thus, the cord guide 44, the cord guide groove 48 and the first and second pulley wheels 38 and 36 serve to redirect the cord 27 substantially 180 degrees so that it can be connected to the second weight 30 in the tank 16. It will be appreciated that other configurations could be used to redirect the cord 27 into the tank 16. For example, the pulley unit 58 could be replaced with an extending member in which a through hole was used to guide the cord 27 rather than the second pulley wheel 36. Similarly, the first pulley wheel 38** could be replaced by other redirecting means.

Preferably, the unit 32 is dimensioned so that once it is affixed to the front wall 11 of a conventional toilet tank, the conventional tank lid for the tank can be installed on the tank without interfering with the operation of the unit 32. Although at least a portion of the tank lid will rest on the connecting section 53 of the support device, preferably the section 53 is of such a size and dimension that it does not adversely affect the installation and stability of the tank lid. The cord guide groove 48 permits the cord 27 to pass under the tank lid of a toilet without being adversely affected by the tank lid.

The catch 34 includes an outwardly extending top portion 56 and an inwardly extending bottom portion 54, which are connected by a middle portion 55. The catch 34 has an open position (which is indicated by the dashed line 57 in FIGS. 5A and 5B) and a closed position (as shown by the solid lines in FIGS. 5A and 5B). The catch 34 is normally in its closed position, unless a user pushes the top 56 of the catch 34 towards the tank 16, which then causes the bottom 54 to swing outwards from the tank and places the catch in its open position. The catch 34 is proportioned so that it automatically swings back to its closed position under the force of gravity once the force applied to the top 56 is removed. A vertical groove 52, which is larger in horizontal cross-section than the diameter of the cord 27 but smaller than the diameter of stopper 46, is located at the end of the bottom 54 of the catch 34 (see FIG. 6). When the catch 34 is in its closed position its bottom 54 extends under the cord guide 44 such that the cord 27 passes through the groove 52.

The location of the stopper 46 on the cord 27 is such that when the first weight is in its highest position (as shown in FIG. 1) and the catch 34 is in its closed position, the stopper 46 is received within the receptacle 47 (as shown in FIG. 5A) in the guide 44. When the first weight is in its highest position, the bottom of the stopper 46 rests on the upper surface of the bottom 54 of the catch 34 and because the stopper 46 is larger than the groove 52, the bottom 54 of the catch 34 acts as a catch which prevents the downward movement of the stopper 46 (and thus the cord 27). As a result, the cord 27 applies an upwards force on the further lever arm 26 which prevents clockwise rotation of the pivot shaft 18 and upwards movement of the toilet seat.

The second weight 30 is of such a density and buoyancy that the force it applies on the cord 27 is substantially affected by the presence or absence of water in the tank 16. The weight 30 is positioned in the tank 16 so that it does not interfere with the standard flushing mechanism found in conventional toilets. In the preferred embodiment the toilet 10 is equipped with a commonly available compact flushing unit sold by Brass Craft of Canada as part number PS2065 in which the water control float is located in the left side of the tank. The toilet seat apparatus of the present invention is able to co-exist with such a flushing system as well as with most conventional tank based flushing systems.

The weight 30 may be of such a density that it floats on the water in the tank 16, however it preferably has a slightly negative buoyancy so that it will sink in water under its own weight. One benefit of having a weight 30 which sinks in the water is that it can help to conserve on water consumption by the toilet 10.

Referring to FIGS. 1 and 2, it will be appreciated that the shaft 18 is subjected to three different rotational forces by the three lever members or arms 24, 26 and 28. The first weight 20 applies clockwise rotational forces on the shaft 18 through the first lever 24. The weight 30 and catch 34 can apply counter clockwise rotational forces to the shaft 18 through the cord 27 acting on the further lever arm 26. Finally, the weight of the toilet seat 12 can apply counter clockwise rotational forces to the shaft 18 through the lever arm 28.

The operation of the preferred embodiment described above and illustrated in FIGS. 1 to 7 is as follows. In the present embodiment the toilet seat lid 14 is manually placed in a raised position and generally left there throughout the operation of the toilet seat. Other embodiments of the invention in which the toilet seat apparatus also controls the raising and the lowering of a toilet seat lid or member will be described further below.

The normal state of the apparatus of the invention is shown in FIG. 1, and FIG. 5A illustrates the unit 32 in its normal position. In the normal position, the toilet seat or toilet member 12 is maintained in a lowered position; the first weight 20 is in its highest position; the tank 16 is full of water; the second weight 30 is submerged in the water in the tank 16; and the catch 34 of the unit 32 is in its closed position. In this normal position, the clockwise rotational force applied to the shaft 18 by the first weight 20 through the lever arm 24 is insufficient to overcome the counter clockwise forces applied to the shaft 18 by the further lever arm 26 and the lever arm 28.

The force applied by the lever arm 26 is a result of the cord 27 and the stopper 46, the cord being restrained from downward movement by the bottom 54 of the catch 34. In the normal state, any tension or force applied to the cord 27 above the stopper 46 is inconsequential and therefore the second weight 30 has no real function in maintaining the seat 12 in its lowered, normal position.

A person desiring that the toilet seat 12 be moved to its raised position presses the top 56 of the catch 34, which forces the catch 34 temporarily into its open position, as illustrated by the dashed line 57 in FIGS. 5A and 5B. When the catch 34 is open, the stopper 46 is no longer restrained by the bottom 54 of the catch. In the absence of the restraining force of the catch 34, the only upwards force applied to the lever arm 26 is whatever force is applied by the second weight 30 to the cord 27. However, because there is water in the tank 16, the second weight 30 is at least partially supported by the buoyant forces of the water and therefore the force applied by the second weight 30 on the cord 27 is insufficient to overcome the rotational forces being applied to shaft 18 by the first weight 20. As a result, when the catch 34 is in its open state, the first weight 20 places, through the lever arm 24, the pivot shaft 18, and the lever arm 28, an upwards rotational force on the toilet seat 12. This force causes the seat or toilet member 12 to rotate about the shaft 18 to its raised position, as is shown in FIG. 2. The clockwise rotation of the shaft 18 also causes the cord 27 to raise the weight 30 up in the tank 16.

When the toilet seat 12 reaches its raised position, the first weight 20 reaches its lowest position, and the second weight 30 reaches its highest position in the tank 16. At least a portion of the surface of the second weight 30 remains in contact with the water in the tank 16 and the respective masses of the weights 20 and 30 are such that as long as the level of the water in the tank 16 is maintained, the seat raising force of weight 20 will be greater than the seat lowering force of weight 30. In its raised position, the seat 12 is preferably biased slightly in a forward direction so that, but for the force of the lever arm 28, it would swing into its lowered position under its own weight. Such a bias may be achieved by attaching a standoff (not shown) to the front wall 11 near the top of tank 16. The standoff would prevent the lid 14 from resting directly against the tank 16, and although the standoff would not be sufficient to cause the lid 14 to be biased towards it is lowered position, the combination of the standoff and the lid 14 would cause the raised seat 12 to be biased towards its lowered position.

Once the top 56 of the catch 34 is released by the user, which can occur any time after the stopper 46 has been released by the catch 34, the catch 34 will once again return to its closed state wherein the cord 27 passes through the groove 52 at the bottom 54. As the stopper 46 has moved below the bottom 54 of the catch 34 (as illustrated in FIG. 5B), the catch 34 applies no vertical force on the cord 27 while the toilet seat remains in the raised position.

The toilet seat will stay in its raised position as shown in FIG. 2 until the toilet 10 is flushed in the conventional manner by a user activating the flushing lever 60. In a manner well known in the art, flushing the toilet 10 causes water in the tank 16 to be drained into the bowl area of the toilet. As the water level drops in the tank, the second weight 30 no longer receives any support from the buoyant forces of the water, with the result that the force applied on the cord 27 by the weight 30 increases substantially. The increased force is such that the counter-clockwise rotational force applied by the cord 27, through the further lever arm 26 is sufficient to overcome the clockwise rotational force applied on the shaft 18 by the first weight 20. This imbalance in forces causes the shaft 18, and thus the lever arm 28, to rotate in a counter-clockwise direction. As a result, the seat 12, which is supported by the lever arm 28, pivots about the shaft 18 into its lowered position. Simultaneously, the first weight 20 will rise to its highest position and the second weight 30 will drop in the tank 16 to its lowest position.

It will be appreciated that when the toilet 10 is flushed, the water does not instantly leave the tank 16, but rather drains out of it over the course of a few seconds. Thus the second weight 30 does not immediately drop to the bottom of the tank 16, but instead it drops as the water level drops until the seat 12 reaches its lowest position. In this manner, the descent of seat or member 12 is a controlled and relatively silent process that occurs over approximately the same length of time it takes for the water to drain from the tank 16.

As the second weight 30 lowers into the tank 16, the portion of the cord 27 outside of the tank 16 moves in an upwards direction and the stopper 46 moves upwards to the bottom 54 of the catch 34 which is in its closed position. The lower surface of the bottom 54 of the catch 34 is curved upwards such that when the stopper 46 contacts the underside of the bottom 54, while moving upwards, the stopper 46 automatically forces the catch 34 to pivot slightly towards its open state, thereby allowing the stopper 46 to pass by the bottom 54, and into the stopper receptacle 47. Once the stopper 46 passes by the bottom 54, the catch 34 returns to its fully closed position wherein the cord 27 passes through the groove 52 provided in the bottom 54.

The length of the cord 27 and location of the stopper 46 is such that the lowest point of the second weight 30, and conversely the highest point of the first weight 20, is defined by the point at which the stopper plug 46 contacts the upper surface of the receptacle 47 in the cord guide 44. The stopper 46 is located on the cord 27 so that it reaches its upper limit at substantially the same time the seat 12 reaches its lowered position.

As is well known in the art, soon after, or concurrent with the draining of water from the tank 16 during the flushing process, new water is supplied to the tank 16. As the water level in tank 16 begins to rise again, the weight 30 will once again be subjected to the buoyant forces of the water. As explained above, when the weight 30 is subject to the buoyant force of the water in the tank 16, the force it applies, via cord 27, on the shaft 18 is insufficient to overcome the toilet seat lifting force of the first weight 20. However, by the time this occurs, the downward movement of the cord 27 is limited by the bottom 54 of the catch 34, which engages the stopper 46 as described earlier. Thus the seat 12 is maintained in a lowered position for the next user to come along.

It will be understood that if the toilet tank is flushed with the seat 12 in its lowered position, the seat 12 will remain in its lowered position throughout the whole process and will not be acted on by the apparatus of the invention.

In the embodiment illustrated in FIGS. 1 to 3, the lever arm 28 is not rigidly attached to the toilet seat 12 but instead rests against the underside of the seat 12 so that, if desired, the toilet seat 12 can be raised manually without causing the shaft 18 to rotate.

From the above description, it will be appreciated that the invention provides an apparatus which can be activated by a user to raise a toilet seat without requiring the user to bend over and lift the seat by hand. Such an apparatus is beneficial for hygienic reasons and also for users with lower back problems. Additionally, a raised toilet seat is automatically placed back in its lowered position after the toilet has been flushed, which ensures that subsequent users are spared the often frustrating inconvenience of lowering a seat left in a raised position by a previous user.

Although the embodiment of the invention described above requires that the toilet seat lid 14 be left in a raised position or otherwise manually operated, it is possible that the first weight 20 could be of sufficient mass to raise both a lowered lid 14 and seat 12 simultaneously, if desired.

Figure 7:
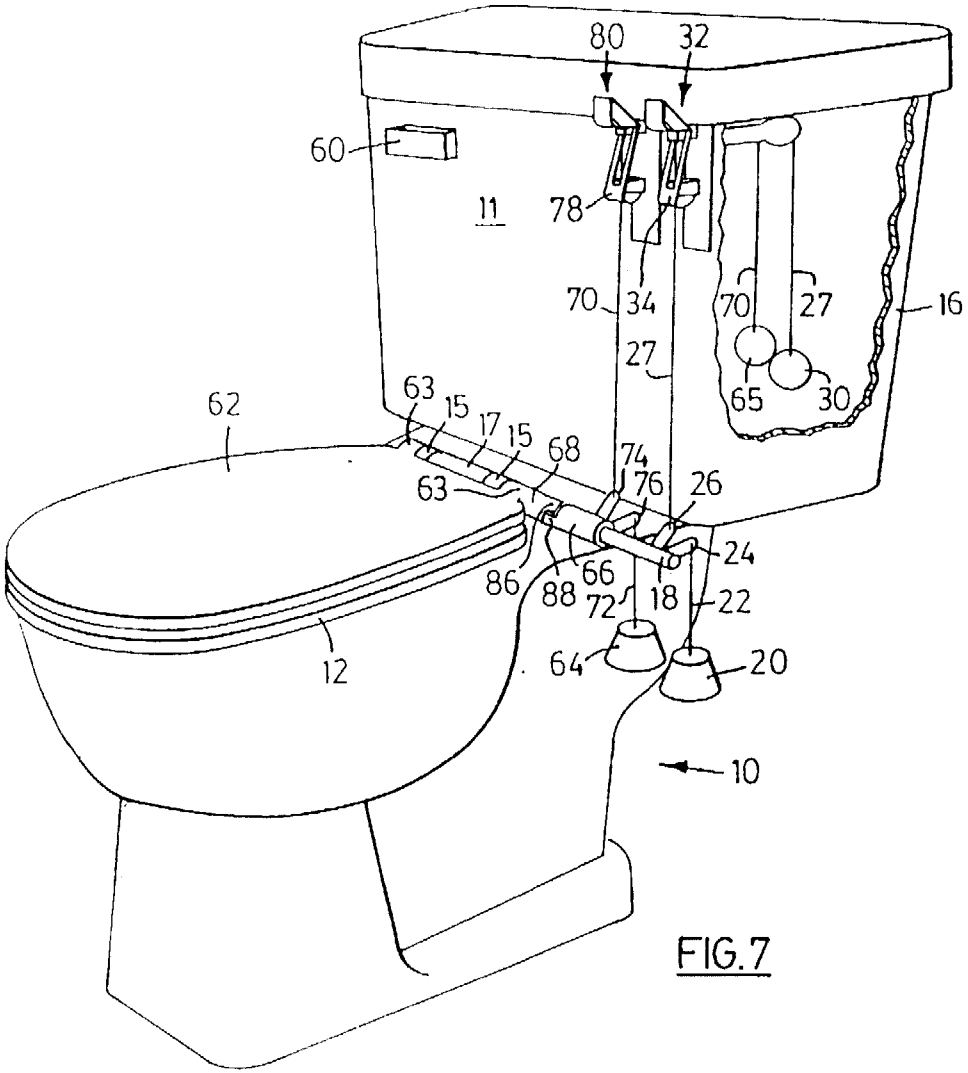
FIG. 7 is a right perspective view of a further embodiment of the invention applied to a toilet with the seat and seat lid in a lowered position.
Figure 9:
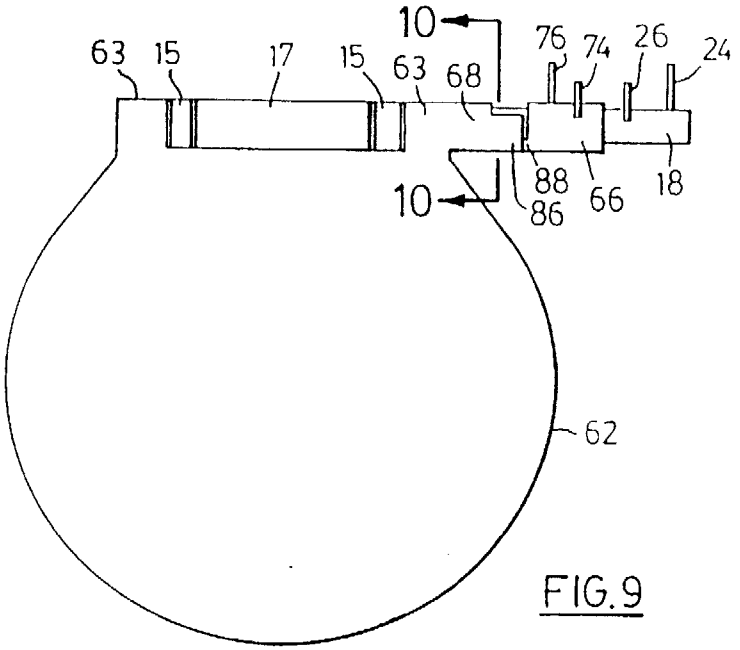
FIG. 9 is a partial top view of the embodiment of FIG. 7 applied to a toilet.

Additionally, the apparatus of the invention can be adopted to provide for independent operation and control of a toilet seat lid. Referring to FIG. 7, the raising and lowering apparatus illustrated in FIGS. 1 through 6 is shown mounted on the toilet 10 together with a lid raising and lowering apparatus which is capable of raising and lowering a toilet seat lid 62. The lid raising and lowering apparatus is similar to and operates in substantially the same manner as the seat raising and lowering means described above, except as hereinafter described.

The lid raising and lowering apparatus includes, among other things, a first lid weight 64 for raising the lid or pivoting toilet member 62, a second lid weight 65 for lowering the lid 62, a lid engaging shaft sleeve 66, and a lid unit 80 (shown in FIG. 8) which includes a lid catch 78.

The shaft sleeve 66 is rotatably attached to the shaft 18 such that the shaft sleeve 66 can rotate independently of the shaft 18 and vice versa. Two lever arms 76 and 74 are rigidly attached to and extend radially outward from the shaft sleeve 66. When both the seat 12 and lid 62 are in the lowered position, as illustrated in FIG. 7, the lever arms or members 76 and 74 are substantially parallel to the lever arms 24 and 26, respectively. The lever arm 76 is connected to the first lid weight 64 by a cord 72 and the lever arm 74 is attached, by a cord 70 to the second lid weight 65. The cord 70 passes through and is redirected into the tank 16 by the unit 80. A stopper 79, which is identical to the stopper 46, is attached to the cord 70. The lid unit 80 is identical to the unit 32 described above.

In terms of providing the rotational forces required to raise and lower the lid 62, the shaft sleeve 66 performs a function relative to the lid 62 that is similar to the function performed by the shaft 18 relative to the seat 12.

The lid 62, which is pivotally mounted to the toilet about the shaft 18 by lid mounting lugs 63, is capable of rotating relative to the shaft 18. A lid sleeve 68 is rigidly attached to a mounting lug 63 of the lid 62, and the lid sleeve 68 extends axially along the shaft 18 towards the shaft sleeve 66.

In the embodiment of the invention illustrated in FIGS. 7 to 10, the two sleeves 66 and 68 engage each other so as to permit the lid 62 to be raised by rotation of the shaft sleeve 66 or by other means independently of the shaft sleeve 66. An extension 86 extends from the end of the lid sleeve 68 closest to the shaft sleeve 66, and an extension 88 extends from the end of the shaft sleeve 66 closest to the lid sleeve 68. The extensions 88 and 86 extend along different portions of the outer circumference of the shaft 18 and both extend beyond each other in the axial direction relative to the shaft 18. Referring to FIG. 10A, a cross-sectional view of the interface between the sleeves 68 and 66 is shown at the time when the lid 62 is in the lowered position (such as in FIGS. 7 and 9). The lid sleeve extension 86 is located just adjacent to and clockwise from the shaft sleeve extension 88. Thus, any clockwise rotation of the shaft sleeve 66 will cause the shaft sleeve extension 88 to engage the lid sleeve extension 86 at a contact surface 90. Clockwise rotation of lid sleeve extension 86, which is rigidly attached to the lid 62 by the lid sleeve 68, will result in the lid 62 being pivoted about the shaft 18 in an upwards direction into its raised position. FIG. 10B shows the position of the lid sleeve extension 86 and the shaft sleeve extension 88 when the lid 62 has been forced into its raised position by rotation of the shaft sleeve 66.

Figure 10C:
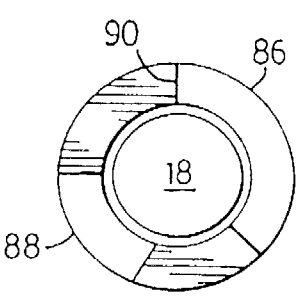
FIG. 10C is a view of the sleeve interface of FIG. 10A, with the seat lid in a raised position.
Figure 10B:
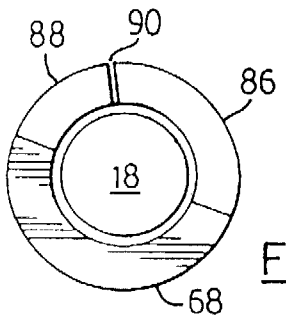
FIG. 10B is a view of the sleeve interface of FIG. 10A, with the seat lid in a raised position.
Figure 10A:
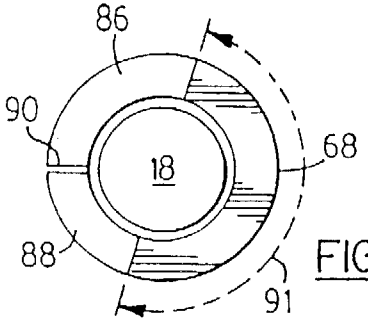
FIG. 10A is a cross-sectional view taken along the line 10—10 of FIG. 9 with the seat lid in a lowered position.

The interface between the sleeves 66 and 68 permits the lid 62 to be rotated about the shaft 18 without any movement of the sleeve 66 because the lid sleeve extension 86 can be rotated clockwise a substantial number of degrees (as illustrated by the dashed line 91 in FIG. 1OA) about the shaft 18 before coming in contact with the shaft sleeve extension 88. FIG. 10C shows the relative locations of the shaft sleeve extension 88 and the lid sleeve extension 86 when the lid 62 has been raised independently of any movement by the shaft sleeve 66. It will be appreciated that a number of different arrangements could be used to allow the lid 62 to be rotated independently of the shaft sleeve 66.

Figure 8:
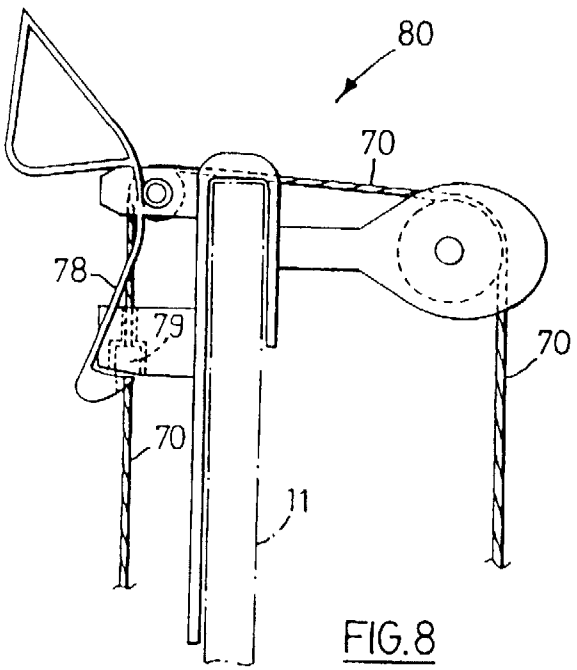
FIG. 8 is a side view of a lid catch unit of this further embodiment.

Referring to FIGS. 7 and 8, the operation of the embodiment of the apparatus of the invention which includes lid raising and lowering means is explained below. In a normal state, the toilet seat 12 and lid 62 are maintained in lowered position; the weights 20 and 64 are in their highest positions; the tank 16 is full of water; the second weights 30 and 65 are submerged in the water in the tank 16; and the catches 34 and 78 of the units 32 and 80, respectively, are in closed positions.

A person desiring that the toilet seat lid 62 be moved into its raised position independent of seat 12 presses the top of the catch 78, which forces the catch 78 temporarily into its open position, thereby releasing the stopper 79. In the absence of the restraining force of the catch 78 on the stopper, the only upwards force applied to the lever arm 74 is whatever force is applied by the second lid weight 65 to the cord 70. However, because there is water in the tank 16, the second lid weight 65 is at least partially supported by the buoyant forces of the water and the force applied by the second lid weight 65 on the cord 70 is insufficient to overcome the rotational forces being applied to the shaft sleeve 66 by the first lid weight 64. As a result, when the catch 78 enters its open state, the first lid weight 64 places, through the lever arm 76, the shaft sleeve 66, and the lid sleeve 68, an upwards rotational force on the toilet seat lid 62. This force causes the lid 62 to rotate about the shaft 18 to its raised position. The clockwise rotation of the sleeve 66 also causes the cord 70 to raise the weight 65 up in the tank 16.

When the toilet seat lid 62 reaches its raised position, the first lid weight 64 reaches its lowest position, and the second lid weight 65 reaches its highest position in the tank 16. At least a portion of the surface of the second lid weight 65 is in contact with the water in the tank 16 and the respective masses of the weights 64 and 65 are such that as long as the level of the water in the tank 16 is maintained, the lid raising force of the weight 64 will be greater than the lid lowering force of the weight 65. In its raised position, the lid 62 is preferably biased slightly in a forward direction so that, but for the force applied by the lever arm 76, it would swing into its lowered position under its own weight. Such a bias may be achieved by attaching a standoff (not shown) to the front wall 11 near the top of tank 16. The standoff would prevent the lid 14 from resting directly against the tank 16.

The toilet seat lid 62 will stay in its raised position until the toilet 10 is flushed in the conventional manner by a user activating the flushing lever 60. As the water level drops in the tank 16 during the flushing process, the second lid weight 65 no longer receives any support from the buoyant forces of the water, with the result that the force applied on the cord 70 by the weight 65 increases substantially. The increased force is such that the counter-clockwise rotational force applied by the cord 70, through the lever arm 74 is sufficient to overcome the clockwise rotational force applied on the sleeve 66 by the first lid weight 64. This imbalance in forces causes the sleeve 66, and thus the lid sleeve 68, to rotate in a counter-clockwise direction. As a result, the lid 62 pivots about the shaft 18 into its lowered position. Simultaneously, the first lid weight 64 will rise to its highest position and the second lid weight 65 will lower in the tank 16 to its lowest position.

It will thus be appreciated that the present invention provides a toilet seat apparatus which can be activated by a user to raise a toilet seat lid independently of a toilet seat without requiring the user to bend over and lift the lid by hand. Additionally, the apparatus of the invention ensures that the lid is placed in a lowered position after flushing.

Referring to the embodiment of the invention illustrated in FIG. 7, it will be appreciated that the apparatus of the invention can be used to raise both the lid 62 and the seat 12 simultaneously by pressing the catches 34 and 78 at the same time, which would cause both the sleeve 66 and the shaft 18 to rotate in the manner described above. If desired, the lid 62 and the seat 12 could be raised in sequence.

Figure 11:
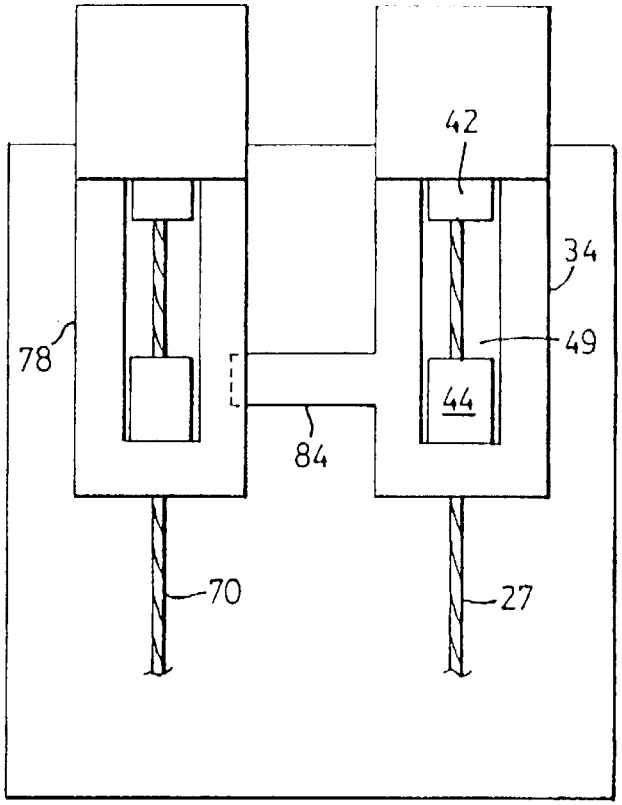
FIG. 11 is a front view of a combined catch unit of the invention.

Although in the embodiment of the invention shown in FIG. 7 the units 32 and 80 are shown as separate units, they can be joined together so that they share a common support device. Additionally, in order to assist a user in activating both of the catches 34 and 78 simultaneously, an extension 84 (see FIG. 11) can be added to the middle portion 55 of the catch 34. The extension 84 engages the back of the catch 78 so that activation of the catch 34 also results in activation of the catch 78, but independent activation of the catch 78 does not activate the catch 34. Of course, the magnitude of the first weight 20 and the second weight 30 could be selected so that activation of the catch 34 alone would be sufficient to raise both the seat 12 and the lid 62 without requiring the extension 84 to activate the catch 78.

Although in the embodiment illustrated in FIG. 7, the weights 65 and 30 which are located in the tank 16 are indicated to be separate weights, it is possible that the weights 65 and 30 could be a single weight to which each of the cords 70 and 27 were attached. Of course, if a single weight were used, when the lid 62 was in a raised position and the seat 12 was lowered, the single weight would be raised in the tank, which would result in a loss of any tension in the cord 27 above the stopper 46. However, as explained above, tension in the cord 27 above the stopper 46 is not required for maintaining the seat 12 in its lowered position (and also, tension in the cord 70 above the stopper 79 is not required for maintaining the lid 62 in a lowered position).

As the weights 30 and 65 (or a combined weight) only have to apply downward forces on the cords 27 and 70, respectively, when water is leaving the tank 16, it is possible that the weights 30 and 65 (or the combined weight) could be weights that float on water. Alternatively, they could be attached to the float ball in a toilet where the float ball is extended to the right side of the toilet tank.

It will be appreciated that the magnitude of the weights described above and the lengths of the lever arms 24, 26, 74 and 76 could be varied so that the apparatus of the invention could be used with a wide variety of toilets that have tank based flushing systems. Preferably, the apparatus of the present invention would be packaged as a kit, together with a toilet seat and toilet seat lid, that could be easily installed on a conventional toilet. The kit could include a cover which could be suspended from the tank 16 so that it concealed a substantial portion of the units 32 and 80 and the cords 27 and 70 from view.

While various embodiments of this invention have been illustrated in the accompanying drawings and described above, it will be evident to those skilled in the art that changes and modifications may be made therein without departing from the essence of this invention. All such modifications or variations are believed to be within the sphere and scope of the invention as defined by the claims appended hereto.

I therefore claim:

1. An apparatus for raising and lowering a pivoting toilet member mounted on top of a toilet bowl, said bowl being part of a flushing toilet equipped with a water tank, said apparatus comprising:

first and second weights, said first weight being connectible to said toilet member and provided to raise said toilet member, said second weight being adapted for mounting in said water tank and provided to lower said toilet member;

a connecting mechanism for connecting said second weight to said toilet member, said connecting mechanism including an elongate, flexible member capable of extending from said second weight inside said water tank to a connecting point outside said water tank;

a holding mechanism for releasably holding said connecting mechanism in a holding position where said connecting mechanism prevents said toilet member from pivoting from a lowered position to a raised position;

wherein during use of said apparatus, if said toilet member is in said lowered position, disengagement of said holding mechanism from said connecting mechanism causes said toilet member to be pivoted to its raised position due to downward movement of said first weight and, if said toilet member is in said raised position and the toilet is flushed, said toilet member moves to its lowered position due to downward movement of said second weight in said water tank.

2. An apparatus according to claim 1 wherein said holding mechanism includes a catch, a support device for pivotably mounting said catch on said water tank, and a stopper fixedly connected to said flexible member at a predetermined position.

3. An apparatus according to claim 2 including a pivotable shaft for connecting said toilet member to a top of said toilet bowl and a first lever member rigidly connected to said shaft and extending radially outwardly therefrom, said first weight being connected to an outer end of first lever member, and wherein said connecting mechanism includes a further lever member rigidly connected to said shaft and extending radially outwardly therefrom, said flexible member being connected to an outer end of said further lever member.

4. An apparatus according to claim 2 wherein said support device comprises two, vertically extending, opposing members and a connecting section that joins said opposing members together at their upper ends, wherein said support device is mountable on a front wall of said water tank so that said opposing members are on opposite sides of said front wall and said connecting section rests on an upper edge of said front wall.

5. An apparatus according to claim 4 wherein said connecting section includes a passage formed therein for passing said elongate member from outside said water tank to inside said water tank, said elongate member being free to move in said passage.

6. An apparatus according to claim 1 including an elongate shaft adapted to be rotatably and horizontally mounted at a rear side of said toilet member and a first lever member rigidly connected to said shaft and extending radially outwardly therefrom, said first weight being connected to an outer end of said first lever member, wherein said connecting mechanism includes a further lever member rigidly connected to said shaft and extending radially outwardly therefrom, said flexible member being connected to an outer end of said further lever member.

7. An apparatus according to claim 6 including a lever arm extending radially from said shaft and adapted for positioning under said toilet member, said lever arm raising said toilet member from said lowered position to said raised position when said shaft is rotated by downward movement of said first weight, said lever arm permitting said toilet member to be raised manually without downward movement of said first weight.

8. An apparatus for a toilet having a toilet bowl, a tank, and a toilet member pivotally mounted on said toilet bowl for pivotal movement about a horizontal axis between a lowered position and a raised position, said toilet having a normal state during which said tank is substantially full of water and a flushing state during which the water is drained from said tank, said apparatus comprising:

a first weight movable between a raised position and a lowered position;

a second weight locatable in said tank such that during use of the apparatus when said toilet is in said normal state, said second weight is acted upon by the buoyant forces of the water in said tank;

means for connecting said first weight and said second weight to said toilet member such that downward movement of said first weight causes said toilet member to rise and downward movement of said second weight when said first weight is not in said raised position causes said toilet member to lower;

a catch connectible to said toilet and having at least a first position and a second position;

a stopper for releasably connecting said catch to said connecting means such that when said catch is in said first position and said toilet member is in its lowered position, said first weight is prevented from moving downwards, wherein when said toilet member is in its lowered position and said toilet is in said normal state and said catch is moved from said first position to said second position, said first weight moves downwards thereby causing said toilet member to move to its raised position, and when said toilet member is in its raised position said toilet is in said flushing state, said toilet member moves to its lowered position under the force of said second weight.

9. An apparatus for a toilet as claimed in claim 8, wherein said stopper is re-engaged automatically by said catch when said first weight moves to its raised position.

10. An apparatus for a toilet as claimed in claim 9, wherein said means for connecting said first weight and said second weight to said toilet member includes an elongate shaft adapted to be rotatably mounted on said toilet along a horizontal axis, a first lever member extending radially from said shaft for engaging said toilet member, a second lever member extending radially from said shaft, an outer end of said second lever member being connected to said first weight, a further lever member extending radially from said shaft, and an elongate member, one end of said elongate member being connected to an outer end of said further lever member, the opposite end of said elongate member being connected to said second weight, said elongate member being flexible for at least a portion of its length, said elongate member passing through means for redirecting said elongate member into said tank such that downward force applied to said elongate member by said second weight is translated through said elongate member into an upward force on the outer end of said further lever member.

11. An apparatus for a toilet as claimed in claim 10 wherein said catch is pivotally connected to a support device having two, vertically extending, opposing members which are joined together at their upper ends by a connecting section, said support device being connectible to said tank such that a portion of a front wall of said tank is located between said opposing members and said connecting section rests on an upper edge of said front wall, said elongate member passing between said support device and said catch such that said stopper can be engaged by said catch when said catch is in said first position and said toilet member is in its lowered position.

12. An apparatus for a toilet as claimed in claim 11 wherein said redirecting means includes a support member extending from said support device into said tank during use of the apparatus, said support member supporting and redirecting said elongate member, and said connecting section includes a groove formed in a top surface thereof for passage of said elongate member.

13. An apparatus for a toilet as claimed in claim 8 wherein said means for connecting said first weight and said second weight to said toilet member permits said toilet member to be raised manually without causing said first weight to move downwards.

14. An apparatus for a toilet as claimed in claim 8, said toilet including a toilet seat lid pivotally mounted on said toilet bowl for pivotal movement about said horizontal axis between a lowered position and a raised position, said apparatus further including:

a third weight movable between a raised position and a lowered position;

a fourth weight locatable in said tank such that when said toilet is in said normal state, said fourth weight is acted upon by the buoyant forces of the water in said tank;

further means for connecting said third weight and said fourth weight to said lid such that downward movement of said third weight causes said lid to rise and downward movement of said fourth weight when said third weight is not in said raised position causes said lid to lower;

a second catch connectible to said toilet, and having at least a first position and a second position;

a stopper for releasably connecting said second catch to said further connecting means such that when said second catch is in said first position and said third weight is in said raised position, said third weight is prevented from moving downwards, wherein when said lid is in said lowered position and said toilet is in said normal state and said second catch is moved from said first position to said second position, said third weight moves downwards thereby causing said lid to move to said raised position, and when said lid is in said raised position and said toilet enters said flushing state, said lid moves to said lowered position under the force of said fourth weight.

15. An apparatus for a toilet as claimed in claim 14 wherein said second weight and said fourth weight are connected together.

16. An apparatus for a toilet as claimed in claim 14, wherein the first mentioned catch engages said second catch such that movement of said first mentioned catch from its first position to its second position causes said second catch to move from its first position to its second position.

17. An apparatus for a toilet as claimed in claim 14, wherein said further means for connecting said third weight and said fourth weight to said lid permits said lid to be manually lifted without causing said third weight to be lowered.

18. An apparatus for a toilet having a toilet bowl, a tank, and a seat pivotally mounted on said toilet bowl for pivotal movement about a horizontal axis between a lowered position and a raised position, said toilet having a normal state during which said tank is substantially full of water and a flushing state during which the water is drained from said tank, said apparatus comprising:

an elongate shaft adapted to be rotatably mounted on said toilet along said horizontal axis;

a first weight movable between a raised position and a lowered position;

means connecting said first weight to said shaft such that downward movement of said first weight causes said shaft to rotate in a first direction;

a second weight locatable in said tank such that said second weight is subject to the buoyant forces of the water in said tank when said toilet is in its normal state;

means connecting said second weight to said shaft such that downward movement of said second weight when said first weight is not in its raised position causes said shaft to rotate in a direction opposite said first direction;

means for connecting said shaft to said seat such that rotation of said shaft in said first direction when said seat is in its lowered position will cause said seat to be raised, and rotation of said shaft in said opposite direction when said seat is in its raised position will cause said seat to be lowered;

means for releasably preventing rotation of said shaft in said first direction when said first weight is in its raised position, the releasability of said rotation preventing means being controlled by a user of the toilet, wherein during use of the apparatus when said seat is in its lowered position, said toilet is in said normal state, and said rotation preventing means is moved to a release position by a user, said shaft is caused by said first weight to rotate in said first direction until said seat is in its raised position, and when said seat is in its raised position and said toilet is in said flushing state, said shaft is caused by said second weight to rotate in said opposite direction until said seat is in its lowered position.

19. An apparatus for a toilet as claimed in claim 18 wherein the rotation of said shaft in said opposite direction causes said rotation preventing means to be automatically reset such that once said seat reaches its lowered position, the rotation of the shaft in said first direction is prevented by said rotation preventing means.

20. An apparatus for a toilet as claimed in claim 19 wherein said weight connecting means includes a lever member which extends radially from said shaft and a flexible elongate member, one end of said elongate member being attached to an outer end of said lever member and the other end of said elongate member being attached to said second weight, said elongate member passing through a redirecting means such that downward force applied by said second weight on said elongate member is redirected into an upward force on said outer end of said lever member so that said lever member applies a rotational force to said shaft in said opposite direction.

21. An apparatus for a toilet as claimed in claim 20 wherein said rotation prevention means includes a support device which is attached to an upper portion of a front wall of said tank, a stopper fixed to said elongate member, and a catch which is pivotally connected to said support device, said stopper located on said elongate member such that when said seat is in said lowered position, said stopper is engaged by a bottom portion of said catch when said catch is in a first position, thereby preventing rotation of said shaft in said first direction, said catch being movable to a second position in which said bottom portion of said catch is disengaged from said stopper, thus permitting rotation of said shaft in said first direction.

* * * * *